US009046014B2

(12) United States Patent
Tadokoro et al.

(10) Patent No.: US 9,046,014 B2
(45) Date of Patent: Jun. 2, 2015

(54) VALVE TIMING CONTROL SYSTEM FOR INTERNAL COMBUSTION ENGINE

(71) Applicant: HITACHI AUTOMOTIVE SYSTEMS, LTD., Hitachinaka-shi, Ibaraki (JP)

(72) Inventors: Ryo Tadokoro, Atsugi (JP); Shinichi Kawada, Isehara (JP); Atsushi Yamanaka, Atsugi (JP); Hiroyuki Nemoto, Hitachi (JP)

(73) Assignee: HITACHI AUTOMOTIVE SYSTEMS, LTD., Hitachinaka-shi (JP)

( * ) Notice: Subject to any disclaimer, the term of this patent is extended or adjusted under 35 U.S.C. 154(b) by 0 days.

(21) Appl. No.: 14/172,249

(22) Filed: Feb. 4, 2014

(65) Prior Publication Data

US 2014/0216374 A1 Aug. 7, 2014

(30) Foreign Application Priority Data

Feb. 6, 2013 (JP) ..... 2013-020966

(51) Int. Cl.

*F01L 1/34* (2006.01)
*F01L 1/344* (2006.01)
*F01L 1/053* (2006.01)

(52) U.S. Cl.

CPC ..... *F01L 1/344* (2013.01); *F01L 2001/0537* (2013.01); *F01L 2001/34496* (2013.01); *F01L 2820/032* (2013.01)

(58) Field of Classification Search

CPC ..... F01L 1/344; F01L 2820/032; F01L 2001/34496; F01L 2001/0537
USPC ..... 123/90.17
See application file for complete search history.

(56) References Cited

U.S. PATENT DOCUMENTS

| | | | | |
|---|---|---|---|---|
| 6,860,247 | B2 * | 3/2005 | Asai et al. | 123/90.17 |
| 6,920,854 | B2 | 7/2005 | Komaki | |
| 2005/0028773 | A1 | 2/2005 | Komaki | |

FOREIGN PATENT DOCUMENTS

| | | | |
|---|---|---|---|
| JP | 2005-061261 | A | 3/2005 |
| JP | 2012-132367 | A | 7/2012 |

* cited by examiner

*Primary Examiner* — Zelalem Eshete
(74) *Attorney, Agent, or Firm* — Foley & Lardner LLP

(57) ABSTRACT

In a valve timing control system for an internal combustion engine, brushes and slip rings are disposed within a space formed between each of an intake air side and an exhaust side device main frames and each of intake air side and exhaust side cover members and partitioned by means of the respective seal members and the respective cover members are configured to enable radial directional position adjustments by a predetermined quantity and are fixed to the internal combustion engine in a state in which the radial directional position adjustments of the respective cover members have been made.

6 Claims, 7 Drawing Sheets

VALVE TIMING CONTROL SYSTEM FOR INTERNAL COMBUSTION ENGINE

BACKGROUND OF THE INVENTION (1) Field of the Invention

The present invention relates to a valve timing control system for use in a valve timing control based on a rotational force of an electrically driven actuator.

(2) Description of Related Art

A Japanese Patent Application First Publication No. 2012-132367 published on Jul. 12, 2012 exemplifies a first previously proposed valve timing control system.

That is to say, in this first previously proposed valve timing control system, utilizing a valve timing control system having: a sprocket which is a drive rotary body synchronously rotated with a crankshaft; a driven rotary body disposed to be relatively rotatable with respect to the sprocket and integrally rotated with a camshaft; and an electrically driven motor with brush which is interlinked to the driven rotary body via a predetermined speed reduction mechanism, the electrically driven motor is drivingly controlled in accordance with the engine driving state so that a relative phase of the camshaft with respect to the crankshaft is modifiable.

In this first previously proposed valve timing control system, a power feed brush is disposed on a cover member side which is attached and fixed to the internal combustion engine and which liquid tightly protects the valve timing control device and a slip ring is disposed on a main body side of the electrically driven motor.

It should be noted that, in a case where the valve timing control devices are installed on both sides of an intake air side and an exhaust side, these devices are closely disposed. Hence, in a usual practice, as described in a Japanese Patent Application First Publication No. 2005-061261 published on Mar. 10, 2005, both of the valve timing control devices are disposed within a single cover member.

SUMMARY OF THE INVENTION

However, in the second previously proposed valve timing control system described above, it is difficult to make axial centers of both of the respective valve timing control devices coincident with an interlinking section of the respective devices in the cover member so that an appropriate electric power feed is not carried out and a problem of an introduction of a worsening of a response characteristic of the devices is raised.

In addition, such a problem occurs that an axial center deviation between the interlinking section of each of the valve timing control devices and each valve timing control device. Thus, such a problem occurs that a worsening of a durability due to an uneven wear of each seal member is introduced.

It is, with the above-described problems in mind, an object of the present invention to provide a valve timing control system for an internal combustion engine which is capable of suppressing a worsening of a response characteristic of the valve timing control devices and a worsening of a seal durability, even if the valve timing control devices are installed on both of an intake air side and an exhaust side.

According to one aspect of the present invention, there is provided a valve timing control system for an internal combustion engine, comprising: brushes; slip rings which slide with the brushes; an intake air side valve timing control device main frame and an exhaust side valve timing control device main frame, both of which are rotated on a basis of a rotational force transmitted from a crankshaft and constitute electrically driven valve timing control devices that modify valve timings by performing a feed of an electric power using the brushes and the slip rings, the electrically driven valve timing control devices being disposed on both of an intake air side camshaft and an exhaust side camshaft; an intake air side cover member and an exhaust side cover member, both of which are fixed to the internal combustion engine and each of which houses a corresponding one of the intake air side device main frame and exhaust side device main frame in an inner peripheral side of a corresponding one of the intake air side and exhaust side cover members; and seal members which seal between an outer periphery of each of the intake air side and the exhaust side device main frames and an inner periphery of each of the intake air side and the exhaust side cover members, wherein the brushes and the slip rings are disposed within a space formed between each of the intake air side and exhaust side device main frames and each of the intake air side and the exhaust side cover members and partitioned by means of the respective seal members and the respective cover members are configured to enable radial directional position adjustments by a predetermined quantity and are fixed to the internal combustion engine in a state in which the radial directional position adjustments of the respective cover members have been made.

According to another aspect of the present invention, there is provided a valve timing control system for an internal combustion engine, comprising: brushes; slip rings which slide with the brushes; an intake air side valve timing control device main frame and an exhaust side valve timing control device main frame, both of which are rotated on a basis of a rotational force transmitted from a crankshaft and constitute electrically driven valve timing control devices that modify valve timings by performing a feed of an electric power using the brushes and the slip rings, the electrically driven valve timing control devices being disposed on both of an intake air side camshaft and an exhaust side camshaft; an intake air side cover member and an exhaust side cover member, both of which are fixed to the internal combustion engine and each of which houses a corresponding one of the intake air side device main frame and exhaust side device main frame in an inner peripheral side of a corresponding one of the intake air side and exhaust side cover members; and seal members which seal between an outer periphery of each of the intake air side and the exhaust side device main frames and an inner periphery of each of the intake air side and the exhaust side cover members, wherein the brushes and the slip rings are disposed within a space formed between each of the intake air side and exhaust side device main frames and each of the intake air side and the exhaust side cover members and partitioned by means of the respective seal members and the respective cover members are configured to enable an adjustment of a relative position between a position at which the intake air side device main frame is housed and a position at which the exhaust side device main frame is housed.

DETAILED DESCRIPTION OF THE INVENTION

Hereinafter, a preferred embodiment of a valve timing control system for an internal combustion engine according to the present invention will be described on a basis of attached drawings in order to facilitate a better understanding of the present invention.

Figure 1:
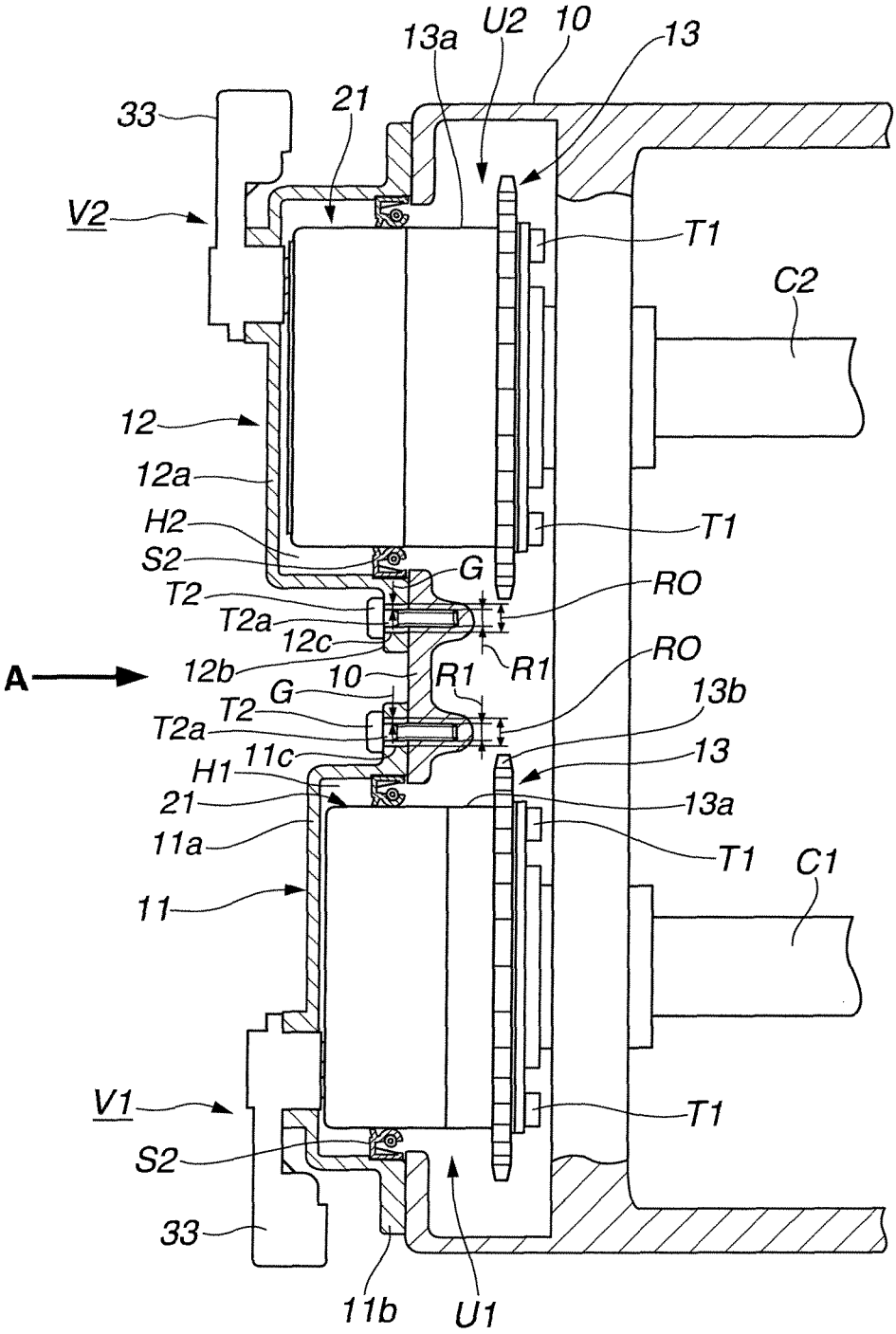
FIG. 1 is a longitudinal cross sectional view of a valve timing control system according to the present invention and a proximity of the valve timing control system.

That is to say, as shown in FIG. 1, the previously proposed valve timing control system according to the present invention includes; an intake air side valve timing control device V1 disposed on an intake air side camshaft C1 which drives an intake valve(s) (not shown); and an exhaust side valve timing control device V2 disposed on an exhaust side camshaft C2 disposed in parallel to intake air side camshaft C1 and which drives an exhaust valve (s) (not shown) and adjacently disposed to intake air side valve timing device V1.

[Intake Air Side Valve Timing Control Device]

First, intake air side valve timing control device V1 will be described below. Intake air side valve timing control device V1 is mainly constituted by: an intake air side (valve timing control) device main frame U1 disposed on an axial end which is a tip of intake air side camshaft C1; and an intake air side cover member 11 disposed so as to cover intake air side device main frame U1 and attached and fixed to an outer side surface of a chain cover 10 disposed at a cylinder head side section (not shown).

Figure 3:
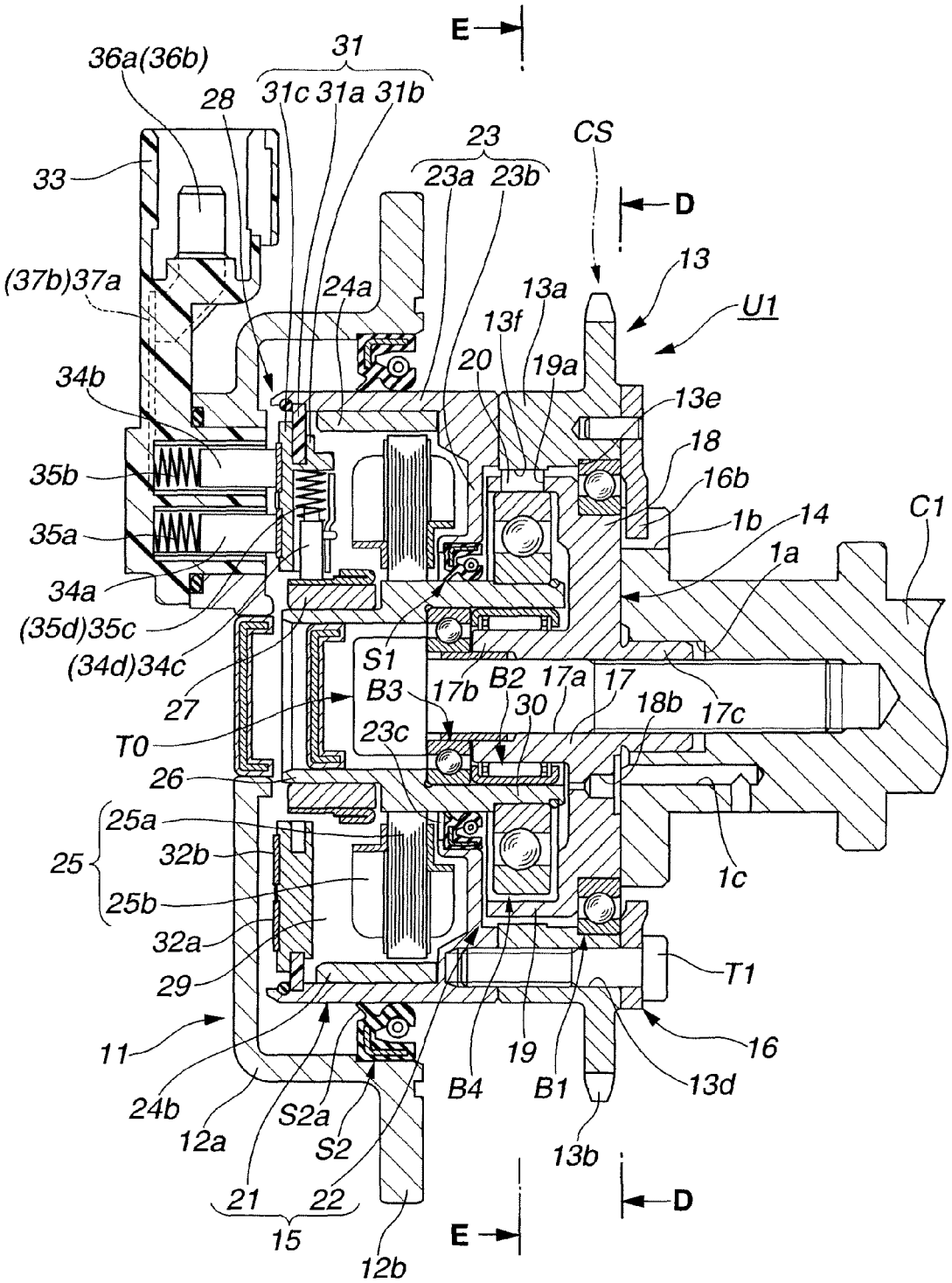
FIG. 3 is a cross sectional view cut away along a line B-B in FIG. 1.

As shown in FIG. 3, intake air side device main frame U1 includes: a substantially cylindrically shaped timing sprocket 13 to which a rotational driving force from a crankshaft CS of the internal combustion engine is transmitted and which is a drive rotary body synchronously rotated together with crankshaft CS; a driven member 14 which is a driven rotary body fixed to one end section of intake air side camshaft C1 rotatably supported on the cylinder head exposed to the outside of the cylinder head of intake air side camshaft C1 and integrally rotated with intake air side camshaft C1; and a phase modification mechanism 15 interposed between timing sprocket 13 and driven member 14 in a form housed within a housing space defined by intake air side cover member 11 and timing sprocket 13 and modifying a relative rotational phase of both of timing sprocket 13 and driven member 14 in accordance with a driving state of the engine.

The whole of above-described timing sprocket 13 is integrally formed with an iron-series metallic material and is constituted by: a cylindrical base section 13*a* constituting a sprocket main frame and having an inner peripheral surface of a stepped difference radial shape; and a gear teeth section 13*b* integrally disposed on an outer periphery of the other end section of cylindrical base section 13*a* and to which a rotational driving force of the crankshaft via a wound timing chain (not shown) is transmitted. Timing sprocket 13 is rotatably supported on a driven member 14 disposed at an inner peripheral side of cylindrical base section 13*a* via a first bearing B1 which is a known ball bearing. Then, an electrically driven motor 21 as will be described later is disposed on one end of cylindrical base section 13*a* so as to close an opening of the one end of cylindrical base section 13*a*. On the other hand, an opening at the other end side of base section 13*a* is closed by a substantially disc shaped stopper plate 16. This disc shaped stopper plate 16 is tightened and fixed by means of a plurality of first bolts T1 to fasten timing sprocket 13 with electrically driven motor 21.

Driven member 14 is integrally formed with: a cylindrical base section 17 disposed at a radial center position of driven member 14; a disc plate section 18 extended toward an outside in the radial direction of driven member 14 at an axial direction middle position of cylindrical base section 17; and a roller holding section 19 extended axially toward electrically driven motor 21 side in a diameter expanded form at an axial directional one end section of disc plate section 18 (an end section of electrically driven motor 21 side) and extended in the axial direction toward electrically driven motor 21 to hold a plurality of rollers 20 along a periphery of roller holding section 19. Then, this driven member 14 is fixed to intake air side camshaft C0 by means of a cam bolt T0 in a state in which a coaxial characteristic with intake air side camshaft C1 is secured by fitting the end section of cylindrical base section 17 at intake air side camshaft C1 side (other end section 17*c* as will be described later) into a recess section 1*a* drilled through intake air side camshaft C1.

This cylindrical base section 17 is provided with an inserting hole 17*a* penetrated along a axial direction at the center section of base section 17. A second bearing B2 is fitted onto an outer peripheral surface of one end section 17*b* (end section of electrically driven motor 21 side as will be described later) which is a known needle bearing. The other end section 17*c* (the end section of intake air side camshaft C1 side) constitutes a convexity section fitted into recess section 1*a* drilled through intake air side camshaft C1. In addition, a third bearing B3 which is a known ball bearing and serves to rotatably support an output shaft member 26 as will be described later is adjacently disposed in the axial direction on the one end side of this cylindrical base section 17. Third bearing B3 is grasped between the one end section of cylindrical base section 17 and a head section of cam bolt T0.

An oil hole 18*b* as will be described later is penetrated through a predetermined position of the peripheral direction of disc plate section 18 to lubricate second and third bearings B2, B3 and so forth from intake air side camshaft C1 side. In addition, first bearing B1 is fitted onto the outer peripheral surface of disc plate section 18. Timing sprocket 13 is rotatably supported on first bearing B1.

Roller holding section 19 is structured substantially cylindrically. Roller holding holes 19*a* are penetrated through predetermined positions in a peripheral direction of roller holding section 19 to serve to hold a plurality of rollers 20. Each of roller holding holes 19*a* houses a corresponding one of rollers 20 and rotatably holds the corresponding one of rollers.

Figure 4:
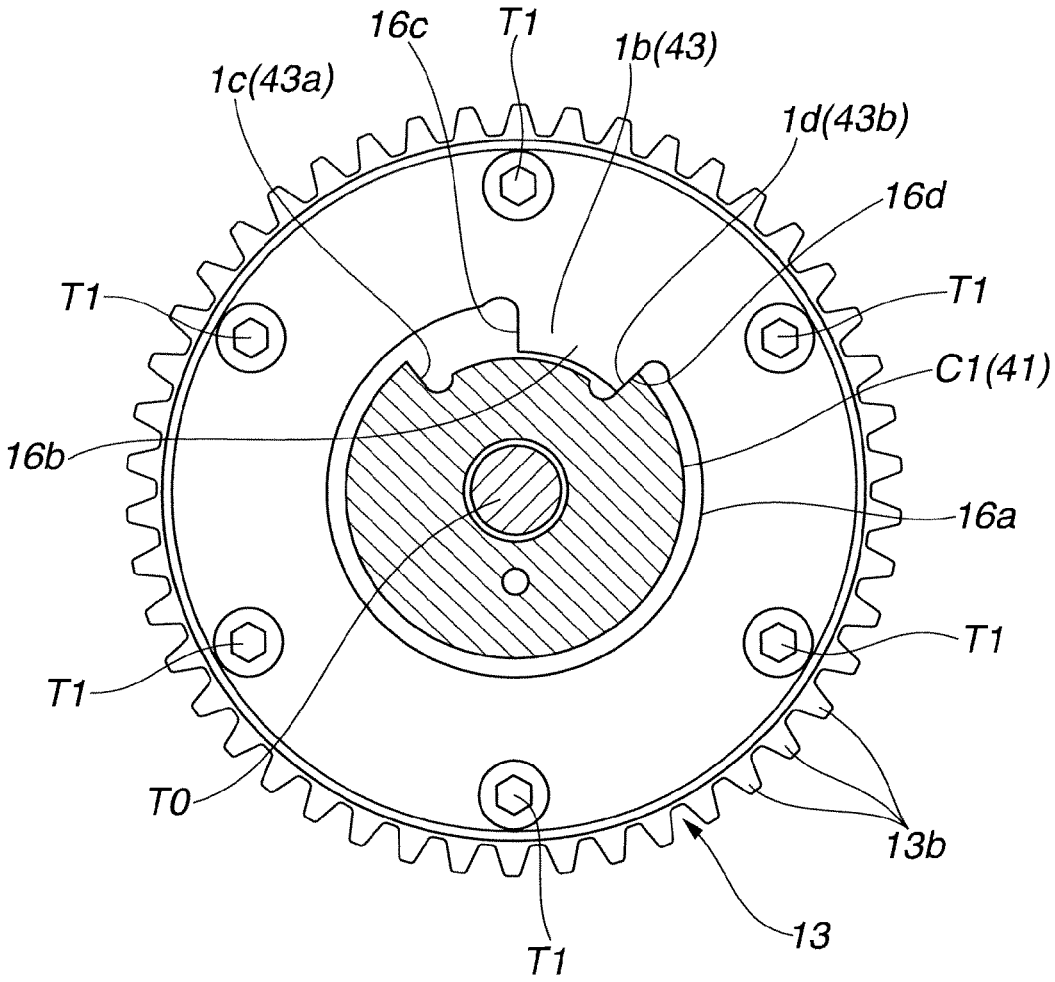
FIG. 4 is a cross sectional view cut away along a line D-D in FIG. 3.

A shaft inserting hole 16*a* is penetrated through a center position of stopper plate 16 to receive one end section of intake air side camshaft C1, as shown in FIGS. 3 and 4. Then, a limitation convexity section 16*b* is projected which is engageably inserted in an arc recess shaped limitation recess section 1*b* which is cut at an outer periphery of one end section of intake air side camshaft C1 in a predetermined range of a peripheral direction of shaft inserting hole 16*a*. When each side end 16*c*, 16*d* of limitation convexity section 16*b* is contacted on a correspondingly opposed side end 1*c*, 1*d* of limitation recess section 1*b*, a relative movement of both intake air side camshaft C1 and stopper plate 16 is limited.

In other words, a relative rotation between driven member 14 and stopper plate 16, namely, the relative rotation between timing sprocket 13 and intake air side camshaft C1 is allowed by only a peripheral direction width range of limitation recess section 1*b*.

Phase modification mechanism 15 is, as shown in FIG. 3, an electrically driven actuator disposed coaxially with intake air side camshaft C1 via driven member 14 and which is rotatably driven according to a control current from an electronic control unit (not shown). Phase modification mechanism 15 is mainly constituted by: an electrically driven motor 21 which serves to generate a phase modification torque; and a speed reduction mechanism 22 interposed between electrically driven motor 21 and driven member 14 and which reduces a speed of an output of electrically driven motor 21. It should be noted that the electronic control unit drivingly controls electrically driven motor 21 on a basis of an engine driving state obtained various kinds of sensors such as a crank angle sensor, a airflow meter, a coolant temperature sensor, a throttle sensor, and so forth.

Electrically driven motor 21 is a DC motor with brush (a first brush 34*a* and a second brush 34*b* as will be described later). Electrically driven motor 21 is mainly constituted by: a bottomed cylindrically shaped yoke 23 which is tightened and fixed to timing sprocket 13 by means of respective bolts T1 so as to be integrally rotated with timing sprocket 13; a pair of halved cylindrical permanent magnets 24*a*, 24*b* which are stators fixed to an inner peripheral surface of yoke 23; an armature 25 which is a rotor rotatably installed on an inner peripheral side of the pair of permanent magnets 24*a*, 24*b*; an output shaft member 26 integrally rotatably inserted into an inner peripheral side of armature 25 and which serves for an output of armature 25; a rectifier 27 mounted at an outer periphery of one end section extended toward a yoke opening side of output shaft member 26; and a power feed section 28 installed on a sealed plate 31 closing the one end side opening of yoke 23 and which serves to supply an electrical power to armature 25 (a coil 25*b* as will be described later) via rectifier 27.

Yoke 23 includes: a cylindrical section 23*a* having an outer diameter set to be the substantially same diameter as cylindrical base section 13*a* of timing sprocket 13; and a bottom wall section 23*b* installed at an end section of cylindrical section 23*a* opposing to timing sprocket 13. An outer side surface of bottom wall section 23*b* closes the one end section opening of timing sprocket 13. In this configuration, yoke 23 is serially disposed in an axial direction with respect to timing sprocket 13 so as to be integrally engaged with timing sprocket 13 and stopper plate 16 by means of respective first bolts T1 penetrated through timing sprocket 13. Thus, seal plate 31 seals the one end section opening of cylindrical section 23*a*.

A shaft inserting hole 23*c* through which output shaft member 26 is inserted is formed at a substantially center position of bottom wall section 23*b*. The other end section of output shaft member 26 exposed to driven member 14 side through shaft inserting hole 23*c* is connected to speed reduction mechanism 22. It should be 1*a* noted that a first seal member S1 is disposed on a hole edge of this shaft inserting hole 23*c* faced toward speed reduction mechanism 22 side to liquid tightly seal a motor housing space 29 formed at the inner peripheral side of yoke 23. This first seal member S1 serves to prevent an flow of lubricating oil into motor housing space 29 from speed reduction mechanism 22 side.

Armature 25 includes: a rotor 25*a* which is an iron core installed at an outer periphery of an axial intermediate section of output shaft member 26; and a plurality of coils 25*b* wound on rotor 25*a*. Each coil 25*b* is electrically connected to power feed section 28 via rectifier 27 so as to enable the electric power reception.

An inner end side of output shaft member 26 at an axial one end side opposing to driven member 14 is supported on a cam bolt T0 via second bearing B2 and the outer end side thereof is supported on driven member 14 via second bearing B2. An eccentric shaft section 30 (as will be described later) which constitutes a part of speed reduction mechanism 22 is integrally installed on the one end section of output shaft member 26. Eccentric shaft section 30 is formed to make an axial shaft center thereof different from any other axial (direction) region.

Figure 5:
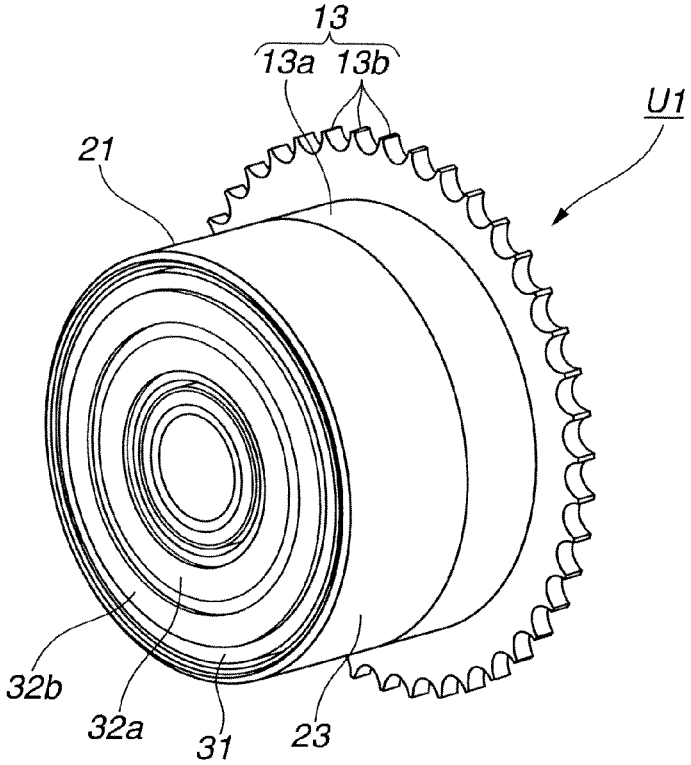
FIG. 5 is a perspective view of a main frame of an intake air side valve timing control device shown in FIG. 1

Power feed section 28 is, as shown in FIGS. 3 and 5, mainly constituted by: a seal plate 31; a pair of first and second slip rings 32*a*, 32*b*; a longitudinally cross sectioned substantially letter of L shaped casing 33; a pair of first and second brushes 34*a*, 34*b*; first and second springs 35*a*, 35*b*; a pair of connection terminals 36*a*, 36*b*; harnesses 37*a*, 37*b*; a pair of third and fourth brushes 34*c*, 34*d*; and third and fourth springs 35*c*, 35*d*.

Seal plate 31 is disposed to close the one end side opening of yoke 23. Seal plate 31 is constituted by: a core member 31*a* made of a substantially disc shaped metallic material; and an inner side insulating section 31*b* and an outer side insulating section 31*c* which are resin made insulating sections and which are mounted on the inner and outer side surfaces of core member 31*a*, respectively. Pair of first and second slip rings 32*a*, 32*b* are disposed on an outer side section of seal plate 31 so as to be in a double form on the outer periphery and the inner periphery in a radial direction of seal plate 31. Pair of first and second slip rings 32*a*, 32*b* are disposed to be exposed to a device housing section H1 (H2) (as will be described later) formed within an intake air side cover member 11 (which is the same as exhaust side cover member 12).

Figure 2:
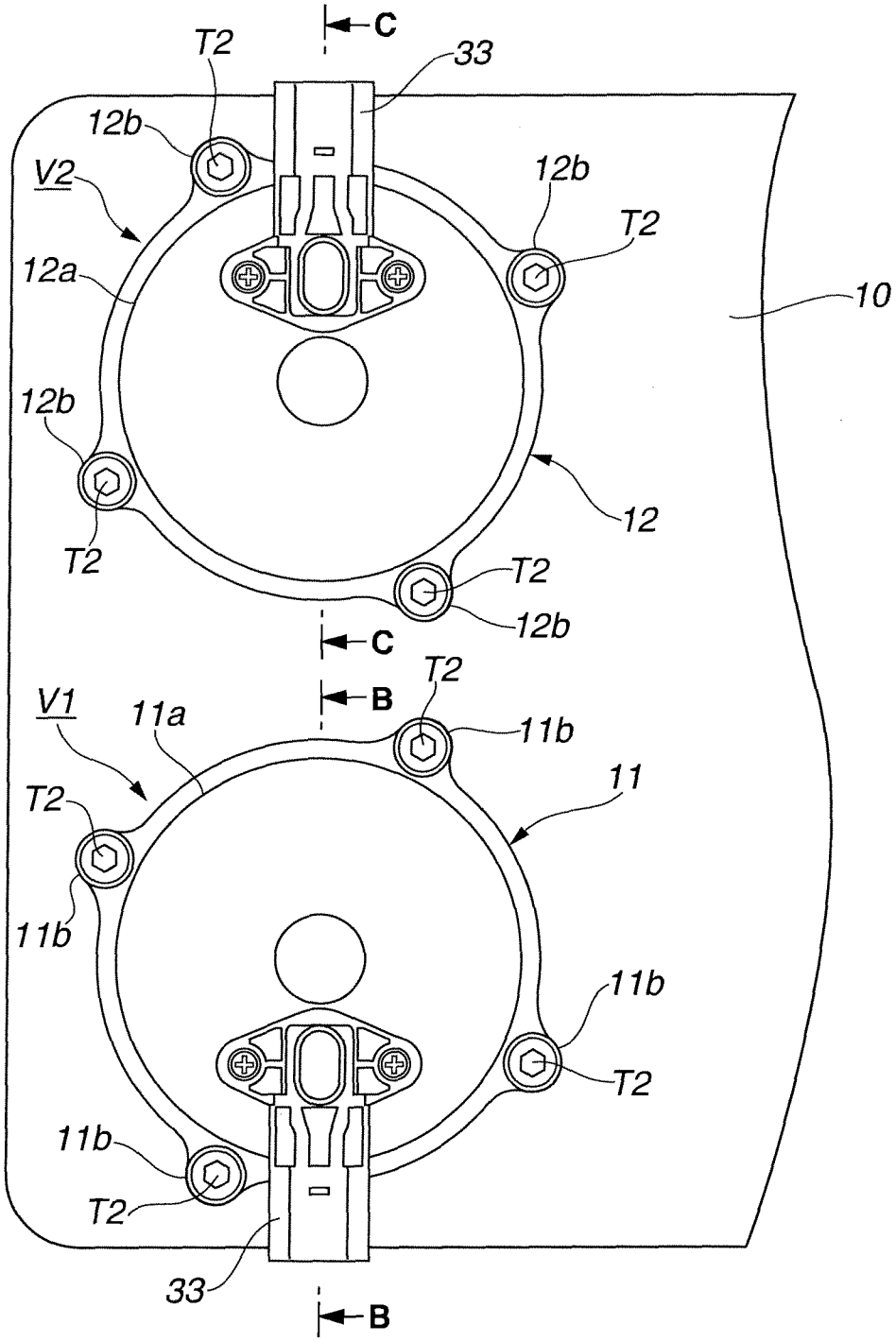
FIG. 2 is an elevation view of the valve timing control system viewed from a direction of A in FIG. 1.

Casing 33 has elongated direction one end section which is a base end section is fitted into an end surface of extension section 11*a* (12*a*) (as will be described later) of intake air side cover member 11 (exhaust side cover member 12) in a form such that the elongated directional one end section is opposed against a part of periphery of both of first and second slip rings 32*a*, 32*b*, as shown in FIG. 2. A pair of first and second brushes 34*a*, 34*b* are positive pole side and negative pole side brushes for the power feed purpose. First and second brushes 34*a*, 34*b* are disposed to be opposed in a vertical direction to a part of the peripheral direction of first and second slip rings 32*a*, 32*b*. First and second springs 35*a*, 35*b* bias these pair of first and second brushes 34*a*, 34*b* toward first and second slip rings 32*a*, 32*b*.

Pair of connection terminals 36*a*, 36*b* are respectively housed in the other end section of casing 33 and are connected to a vehicle battery (not shown).

Harnesses 37*a*, 37*b* serve to connect respective connection terminals 36*a*, 36*b* to first and second brushes 34*a*, 34*b*.

Pair of third and fourth brushes 34*c*, 34*d* for switching purpose are housed within inner side insulating section 31*b* of seal plate 31 and has a tip surface slidably contacted on rectifier 27 from an outer peripheral side. Third and fourth springs 35*c*, 35*d* bias these third and fourth brushes 34*c*, 34*d* toward rectifier 27 side.

Figure 6:
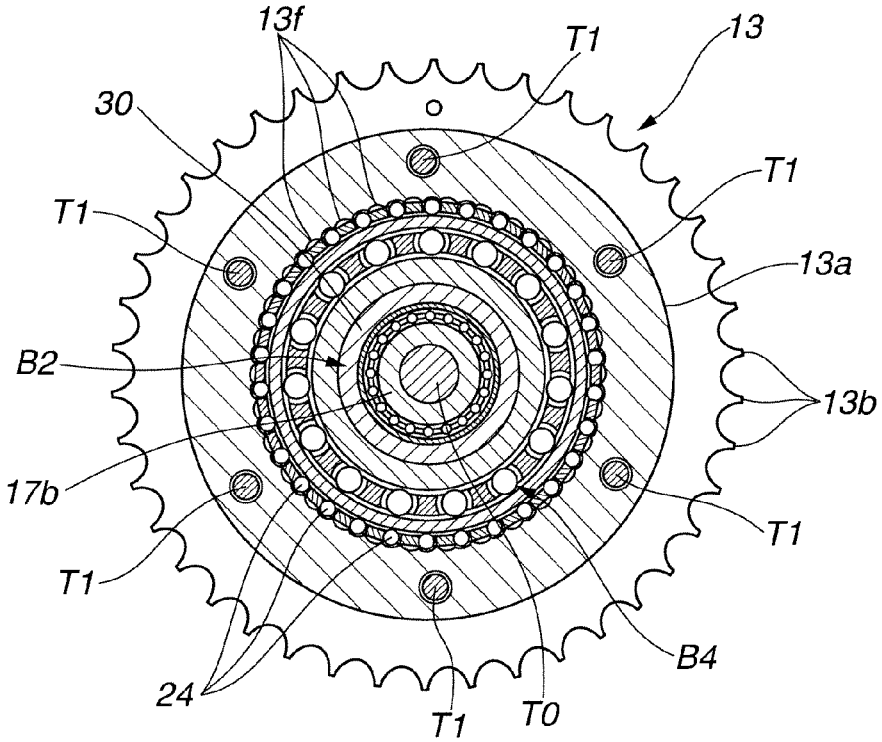
FIG. 6 is a cross sectional view cut away along a line E-E in FIG. 3 (along a line G-G in FIG. 7).

Speed reduction mechanism 22, as shown in FIGS. 3 and 6, includes: eccentric shaft section 30 arranged at one end section of output shaft member 26 of electrically driven motor 21 and structured to make the eccentric rotation (motion) accompanied by the rotation of output shaft member 26; fourth bearing B4 which is a ball bearing of a relatively large diameter and mounted on an outer periphery of eccentric shaft section 30; a plurality of rollers 20 rotatably supported on the outer periphery of fourth bearing B4; and a roller holding section 19 of driven member 14 as a holder structured to allow the axial movement of each roller while holding each roller 20 in a rotation direction.

A substantially whole of the axial direction of fourth bearing B4 and each roller 20 is overlapped on each other in a radial direction thereof. The inner wheel of fourth bearing B4 is press-fitted to an outer peripheral surface of eccentric shaft section 30. Each roller 20 is, at all times, contacted on the outer peripheral surface of the outer wheel of fourth bearing B4. In addition, a multiple number of arc shaped grooves 13*f* are formed over the whole periphery of an inner periphery section of timing sprocket 13 (cylindrical base section 13*a*) opposing against the outer peripheral surface of the outer wheel of to fourth bearing B4.

A circular radial gap having a width equal to or longer than a diameter of each roller 20 is formed between the outer peripheral surface of the outer wheel of fourth bearing B4 and the multiple number of arc grooves is 13*f*. A whole of fourth bearing B4 can make the eccentric rotation accompanied by the eccentric rotation of eccentric shaft section 30 on a basis of the radial gap. Each roller 20 is moved in the radial direction involved in the above-described eccentric motion so that part of rollers 20 is fitted into (or meshed with) arc shaped grooves 13*f*. Consequently, the rotational drive force of timing sprocket 13 is transmitted to driven member 14.

More specifically, a meshed position of each roller 20 and each arc shaped groove 13*f* is deviated by one (one tooth) per rotation of eccentric shaft section 30. On a basis of this structure, the rotation of electrically driven motor 21 is speed reduced and transmitted and the rotation of electrically driven motor 21 causes driven member 14 to be relatively rotated to timing sprocket 13.

Lubricating oil is supplied by means of lubricating oil supply means to an internal of speed reduction mechanism 22. This lubricating oil supply means is mainly constituted by: an introduction passage 1*c* formed in an inner axial direction of intake air side camshaft C1 to introduce lubricating oil from a main oil gallery (not shown) via an inner oil passage (not shown) of a cylinder head; and oil hole 18*b* having one end connected to introduction passage 1*c* and the other end opened to a bearing section constituted by second and fourth bearings B2, B4. The lubricating oil supply means performs the lubrication of each bearing B2, B4 constituting speed reduction mechanism 22 by introducing lubricating oil supplied from a main oil gallery.

Intake air side cover member 11 is, as shown in FIGS. 1 through 3, formed substantially in a cup shape and is made of, for example, aluminum alloy material. Intake air side cover member 11 includes: an expansion section 11*a* expanded and formed at an outside of cover member 11 and which covers an outer periphery of yoke 23; and a flange section 11*b* whose diameter is expanded toward an opening end section of expansion section 11*a* to serve to attach cover member 11 to chain cover 10. Intake air side cover member 11 is tightened to a side section of chain cover 10 by means of a plurality of second bolts T2 inserted through a plurality of bolt inserting holes 11*c* penetrated at predetermined positions of a peripheral direction of flange section 11*b*.

It should, herein, be noted that each bolt inserting hole 11*c* is formed in an approximately circular shape and an inner diameter R0 of each bolt inserting hole 11*c* is set to be sufficiently larger than an outer diameter R1 of an shaft (viz., shank) section T2*a* of each second bolt T2 to be inserted through inserting hole 11*c*. That is to say, according to the structure described above, it becomes possible to adjust a radial directional position of intake air side cover member 11 with respect to intake air side device main frame U1 when intake air side cover member 11 is attached to chain cover 10 utilizing a radial gap G formed between each bolt inserting hole 11*c* and a corresponding one of respective second bolts T2.

A circular second seal member S2 is fitted to an inner periphery of the opening end section of intake air side cover member 11 to liquid tightly partition device housing section H1 structured at the inner peripheral side of expansion section 11*a*. This second seal member S2 is a well known oil seal constituted by a metallic ring and a rubber material. A seal lip S2*a* disposed at the inner peripheral section of second seal member S2 is slidably contacted on an outer peripheral surface of yoke 23. Thus, power feed section 28 (especially, a slidable contact section between first and second brushes 34*a*, 34*b* and first and second slip rings 32*a*, 32*b*) is protected from a foreign matter.

[Exhaust Side Valve Timing Control Device]

Next, exhaust side valve timing control device V2 will be described below.

A basic structure of exhaust side valve timing control device V2 is the same as intake air side valve timing control device V1. Hence, a specific explanation of the structure of exhaust side valve timing control device V2 will be omitted herein since the same reference numerals as those described in intake air side valve timing control device designate the like elements. Thus, only a part of exhaust side valve timing control device V2 which is different from the intake air side valve timing control device V1 will be described below.

That is to say, this exhaust side valve timing control device V2 is, as shown in FIGS. 1 and 2, mainly constituted by: an exhaust side (valve timing control) device main frame U2 disposed at the axial end which is a tip of an exhaust side camshaft C2; and an exhaust side cover member 12 disposed to cover exhaust side device main frame U2 and attached and fixed to an outside surface of chain cover 10.

Figure 7:
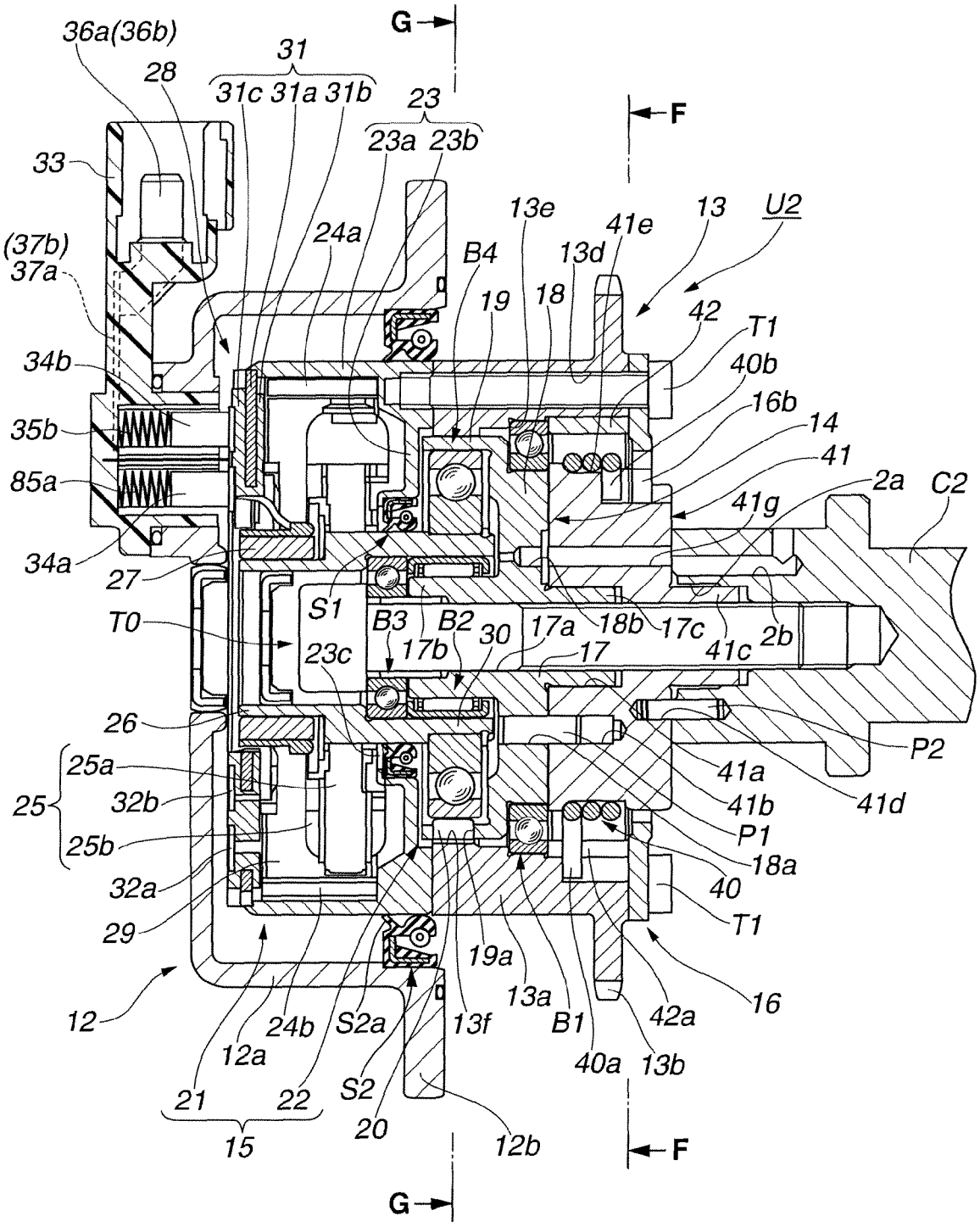
FIG. 7 is a cross sectional view cut away along a is line C-C in FIG. 1.

Exhaust side device main frame U2, as shown in FIG. 7, includes: substantially cylindrical timing sprocket 13 which is the drive rotary body to which the rotational drive force is transmitted from the crankshaft (not shown) and which is synchronously rotated with the crankshaft; driven member 14 which is the driven rotary body integrally rotated with exhaust side camshaft C2 and which is fixed to the one end section of exhaust side camshaft C2 rotatably supported on the cylinder head and exposed to the outside of the cylinder head; and phase adjustment mechanism 15 interposed between timing sprocket 13 and driven member 14 in a form housed in the housing space defined by exhaust side cover member 12 and timing sprocket 13 and modifies a relative rotational phase between both of timing sprocket 13 and driven member 14 in accordance with the engine driving state.

Furthermore, in exhaust side device main frame U2, a spring support member 41 is interposed between driven member 14 and exhaust side camshaft C2, at an inner periphery of an outer end section of timing sprocket 13 and a fail-safe purpose torsion spring 40 is fitted into an outer periphery of spring holding member 41 (a circular groove 41 (*as* will be described later)) to bias exhaust side camshaft C2 toward an advance angle side with respect to timing sprocket 13.

That is to say, in exhaust side device main frame U2, the outer wheel of first bearing B1 is grasped and fixed between an inner peripheral side step section 13*e* of timing sprocket 13 and a substantially circular collar member 42 fitted to an inner peripheral surface of timing sprocket 13. Torsion spring 40 is housed within a radial space formed by collar member 42 and spring support member 41 arranged at the inner peripheral side of collar member 42.

Figure 8:
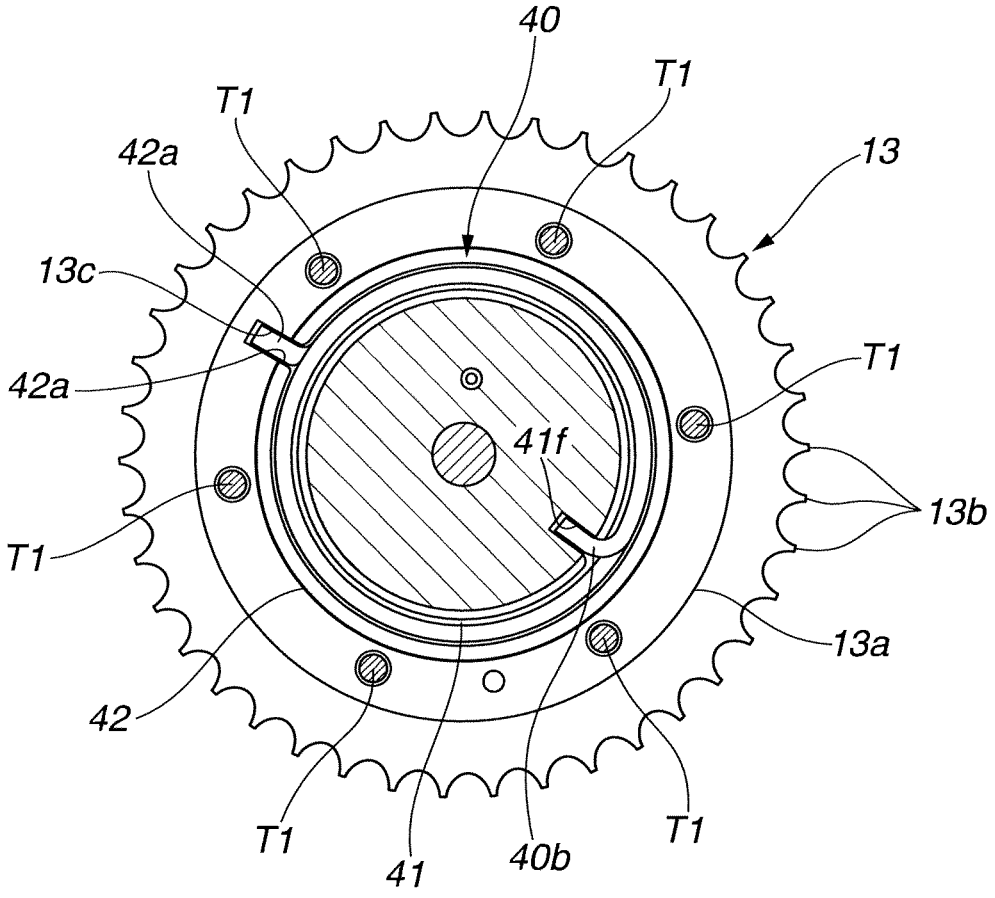
FIG. 8 is a cross sectional view cut away along a line F-F in FIG. 7.

Then, as shown in FIGS. 7 and 8, this torsion spring 40 has one end section 40*a* stopped in an engage to state (seized) in one end seizure groove 13*c* cut and formed on an inner periphery of an outer end section of timing sprocket 13 via a cut out groove 25*a* disposed on a part of a peripheral direction of collar member 25 and has the other end section 40*b* stopped in an engage state (seized) in the other end seizure groove 41*f* cut out on the outer periphery of the outer end side of spring support member 41. Thus, a biasing force of torsion spring 40 can bias driven member 14 toward the advance angle side against an, so-called, alternating torque corresponding to a rotational force in a retardation angle direction transmitted via exhaust side camshaft C2 when the engine is stopped even if a failure in an electrical system in which the phase modification torque of phase modification mechanism 15 (electrically driven motor 21) is not acted upon.

Spring support member 41 is formed substantially in a column shape. The other end section 17*c* of cylindrical base section 17 is fitted into recess section 41*a* drilled through the inner end section of spring support member 41.

A plurality of first positioning pins P1 projected from driven member 14 side are fitted and inserted through a plurality of first positioning holes 41*b* drilled through the outer peripheral region of recess section 41*a* so that spring support member 41 can integrally be rotated with driven member 14. Furthermore, convexity section 41*c* drilled through the outer end section of spring support member 41 is fitted into recess section 2*a* drilled through the end surface of exhaust side camshaft C2 and a plurality of second positioning pins P2 projected from exhaust side camshaft C2 are fitted and inserted into second positioning holes 41*d* drilled through the outer peripheral range of convexity section 41*c* so that spring support member 41 is integrally rotatable to exhaust side camshaft C2.

A circular groove 41*e* is cut out along a circumferential direction of spring support member 41 to serve as an outer fitting of torsion spring 40 at an outer periphery of an inner end side of spring support member 41. A stable holding of torsion spring 40 becomes possible by means of both end sections of circular groove 41*e* in an axial direction of circular groove 41*e*.

On the other hand, as shown in FIGS. 4 and 7, an arc recess shaped limitation recess section 43 into which limitation convexity section 16*b* of stopper plate 16 is engageably inserted is cut out along a predetermined range of the peripheral direction on an outer periphery of an inner end section of spring support member 41 in the same way as limitation recess section 1*b* of intake air side camshaft C1. When each side end 16*c*, 16*d* of limitation convexity section 16*b* is contacted on mutually opposing limitation recess section 43 so that the relative movement of both of stopper plate 16 and spring support member 41 is limited.

Phase adjustment mechanism 15 of exhaust side device main frame U2 is, as shown in FIG. 7, mainly constituted by: electrically driven motor 21 disposed coaxially on exhaust side camshaft C2 via driven member 14 in the same way as the intake air side; and a speed reduction mechanism 22 interposed between electrically driven motor 21 and the driven member 14 to speed reduce and transmit the output of electrically driven motor 21. Phase adjustment mechanism drivingly controls electrically driven motor 21 on a basis of the engine driving state obtained from the various kinds of sensors (not shown) such as the crank angle sensor, the airflow meter, the coolant temperature sensor, the throttle sensor, and so forth.

The lubricating oil supply means is installed within the inner part of speed reduction mechanism 22 of exhaust side device main frame U2 in the same way as the intake side device main frame U1. The lubricating oil supply means is mainly constituted by an introduction passage 2*b* formed along an inner part axial direction of exhaust side camshaft C2 to introduce the lubricating oil from the main oil gallery via an inside oil passage of the cylinder head; a connection passage 41*g* penetrated in the inner axial direction of spring support member 41 to connect introduction passage 2*b* to an oil hole 18*b* as will be described later; and an oil hole 18*b* whose one end is connected to connection passage 41*g* and whose other end is opened to the bearing section including second and fourth bearing B2, B4. In the same way as the intake air side, the lubrication of each of bearings B2, B4 constituting speed reduction mechanism 22 by introducing lubricating oil from the main oil gallery.

Exhaust side cover member 12 is, in the same way as the intake air side, formed in a substantially cup shape and formed of aluminum alloy material as shown in FIGS. 1, 2, and 7, in the same way as the intake air side. Exhaust side cover member 12 includes: an expansion section 12*a* formed and expanded toward the outer side of cover member 12 so as to cover the outer periphery of yoke 23; and an flange section 12*b* whose diameter is expanded toward the opening end of expansion section 12*a* to be attached to chain cover 10. A plurality of second bolts T2 inserted through a plurality of bolt penetrating holes 12*b* penetrated at the predetermined positions of the peripheral direction of flange section 12*b* serve to tighten the side section of chain cover 12*c*.

Then, in the same way as the intake air side, bolt inserting holes 12*c* are formed in substantially is circular shape and its inner diameter R0 of each bolt inserting hole 12*c* is set to be substantially larger than an outer diameter of shank section T2*a* of each second bolt T2 to be inserted. Thus, a radial directional position of exhaust side cover member 11 can be adjusted to exhaust side device main frame U2 utilizing radial gap G formed between each bolt inserting hole 12*c* and each second bolt T2.

Second seal member S2 is fitted into the inner periphery of an opening end section of exhaust side cover member 12 by means of expansion section 12*a* to serve to liquid tightly seal device housing section H2 constituted at the inner peripheral side of expansion section 12*a*. A seal lip S2*a* of second seal member S2 is slidably contacted on the outer peripheral surface of yoke 23 so that power feed section 28 (especially, a slidable contact section between first and second brushes 34*a*, 34*b* and first and second slip rings 32*a*, 32*b*) is protected from the foreign matter.

Next, action and effects of the valve timing control system for the internal combustion engine according to the present invention will be explained below on a basis of FIG. 1.

First, when the engine is started, the intake air side valve timing control device V1 is controlled at a most retardation angle side and exhaust side valve timing control device V2 is controlled at a most advance angle side, respectively. When the crankshaft is rotationally driven by means of a starter motor (not shown), timing sprocket 13 is rotated via the timing chain and its rotational force of timing sprocket 13 causes electrically driven motor 21 to be synchronously rotated via yoke 23 and so forth. In addition, the rotational force of timing sprocket 13 is transmitted to intake air side and exhaust side camshafts C1, C2 via speed reduction mechanism 30 constituted by rollers 20 and roller holding section 23 and its associated driven members 14. The rotation of cams constituted by the respective camshafts C1, C2 brings out the open and closure of the intake valve(s) and the exhaust valve(s) (not shown). In this way, during the engine start, the valve timing control devices are controlled to eliminate a valve overlap so that a spitback of exhaust gas into an intake port is suppressed and a startablity of the engine is improved.

Next, during the engine drive after the engine start, electrically driven motor 21 is rotationally driven on a basis of a control signal from the control unit so that the rotational force of electrically driven motor 21 is transmitted to each camshaft C1, C2 via speed reduction mechanism 22. Thus, each camshaft C1, C2 is relatively rotated in mutually opposite directions with respect to timing sprocket so that a relative rotational phase of both of camshafts C1, C2 is modified. Consequently, a valve open-or-closure timing (valve timing) of the intake air valve or exhaust valve is modified to a desired timing. Specifically, for example, in accordance with the increase in a drive load, intake air side valve timing control device V1 is advance angle controlled and exhaust side valve timing control device V2 is retardation angle controlled so that the valve overlap is increased. According to the related control, an optimization of the combustion is carried out such as the improvement of fuel consumption due to the improvement in the engine torque, due to an improvement in the exhaust emission according to the increase in the internal EGR (Exhaust Gas Recirculation) and due to the reduction in the pumping loss.

In the way described above, in each valve timing control device V1, V2, timing sprocket 13 and electrically driven motor 21 are, at all times, integrally rotated so that second seal member S2 disposed on each cover member 11, 12 is, at all times, slidably contacted on each electrically driven motor 21. Then, during the modification of the valve timing, first and second brushes 34*a*, 34*b* are slidably contacted on first and second slip rings 32*a*, 32*b* in each valve timing control device V1, V2 so that electically driven motor 21 is power received and electrically driven motor 21 is electrically driven.

It should be noted that, in a case where the valve timing control devices V1 and V2 are disposed on both of the intake air side and the exhaust side, each cover member 11, 12 is formed integrally in the previously proposed valve timing control system to reduce the number of parts and to reduce a manufacturing cost of the valve timing control system due to the reduction of man-hour labor cost. Therefore, a shaft center deviation of the respective device housing sections with respect to both of the device main frames U1, U2 in no small numbers occurs from working accuracies of parts such as each cover member 11, 12, the bearing sections of the cylinder head, each camshaft C1, C2, and chain cover 10.

Thus, an appropriate electrical power supply to electrically driven motor 21 is not carried out due to each positional deviation of first and second brushes 34*a*, 34*b* with respect to first and second slip rings 32*a*, 32*b* in each valve timing control device V1, V2 so that a worsening of the response characteristic of the device when the valve timing modification is carried out has been introduced. Furthermore, a distribution of an elastic contact force of second seal member S2 (seal lip S2*a*) against each device main frame U1, U2 in each cover member 11, 12 due to the above-described shaft center deviation becomes uneven. Consequently, an uneven wear occurs in each second seal member S2 and this uneven wear introduces the worsening of the durability of each second seal member S2.

On the other hand, the valve timing control system is conventionally of a hydraulic pressure type and the electrically driven motor is, in the first place, not used. Thus, there is no possibility of introducing the worsening of the response characteristic of the system, even if the shaft center deviation occurs due to the integration of the cover members. In addition, since, in the valve timing control system of the hydraulic pressure type, a working oil is acted up to the inside of the cover member, the lubrication by means of the working oil between the timing sprocket and the seal member is carried out. Therefore, it is difficult to introduce the worsening of the durability based on the uneven wear of the seal member.

On the other hand, in a case of the present invention, in a case where valve timing control devices V1 and V2 are installed for both of the intake air side and the exhaust side, separately independent cover members 11, 12 are installed for the respective valve timing devices V1, V2. In addition, in these cover members 11, 12, each bolt inserting hole 11*c*, 12*c* is set to be sufficiently larger than shaft (shank) section T2*a* of each second bolt T2. Thus, a relative movement of each cover member 11, 12 with respect to each device main frame U1, U2 becomes possible utilizing thus formed radial gap G. In other words, radial gap G permits the relative positions of device housing sections H1, H2 to be adjusted. Thus, when these cover members 11, 12 are attached, the radial positions of respective cover members 11, 12 with respect to respective device main frames U1, U2, namely, the shaft centers can, independently, be adjusted.

Thus, each cover member 11, 12 can be arranged in a state in which each cover member 11, 12 is appropriately shaft center aligned to conform to each device unit main frame U1, U2. Consequently, an optimization of the arrangement for each of brushes 34*a*, 34*a* and second seal members S2 can be achieved. Thus, such inconveniences as the worsening of the response characteristic of the above-described device (electrically driven motor 21) and as the worsening of the durability due to the uneven wear of second seal member S2 can be suppressed.

In addition, in the preferred embodiment described above, each cover member 11, 12 is attached by means of respective second bolts T2. Hence, the positional adjustment of each cover member 11, 12 utilizing each radial gap G becomes possible. A positional adjustment mechanism of each cover member 11, 12 can be realized with a simpler and easy structure. Consequently, there is no possibility of introducing a reduction in productivity of the valve timing control system due to its complexity of the structure and an increase of the manufacturing cost.

In addition, in a case where relatively high rigidity seal members such as respective second seal members S2 in the preferred embodiment are used, an influence of the worsening of the response characteristic and seal durability of valve timing control devices V1, V2 due to the shaft center deviations of the corresponding parts of respective device housing sections H1, H2 becomes remarkably large. However, according to the valve timing control system according to the present invention in which the radial positions of respective cover members 11, 12 can be adjusted, the above-described task can effectively be solved.

The present invention is not limited to the structure in the preferred embodiment. For example, a specific structure of parts or members such as electrically driven motor 21 and speed reduction mechanism 22 may appropriately be modified according to the device and specification of an object to be mounted.

In addition, the position adjustment mechanism of respective cover members 11, 12 is not limited to the position adjustment mechanism according to radial gap G between each second bolt T2 and each bolt inserting hole 11*c*, 12*c*. Any structure of such a mechanism that can adjust the position of each cover member 11, 12 may be used and can freely be modified.

Technical ideas graspable from the embodiment described above will be explained below.

(a) The valve timing control system for the internal combustion engine as claimed in claim 1, wherein the intake air side cover member and exhaust side cover member are fixed to the internal combustion engine by means of a plurality of bolts, respectively.

(b) The valve timing control system as set forth in item (a), wherein the intake air side cover member and exhaust side cover member are configured to enable the radial direction position adjustments on a basis of radial gaps formed between the plurality of bolts and bolt inserting holes through which the respective bolts are inserted.

In the structure described above, radial position adjusting means (section) of each of the cover members (11, 12) can easily be structured.

(c) The valve timing control system as claimed in claim 1, wherein the slip rings are disposed on outer and inner peripheries of a tip surface of each device main frame in a double form and the brushes of a positive polarity and of a negative polarity are disposed on each of intake air side cover member and exhaust side cover member to be projected toward the respective slip rings.

(d) The valve timing control system as claimed in claim 1, wherein each seal member is an oil seal constituted by a metallic ring and a rubber material.

If the seal member having the high rigidity is adopted, an influence of the worsening of the response characteristic of each valve timing control device and the worsening of the seal durability due to the shaft center deviation of the respective cover members becomes larger but, in the case of the present invention in which the radial direction position of each cover member is adjustable, each cover member can appropriately be attached so that the above-described task can more effectively be solved.

This application is based on a prior Japanese Patent Application No. 2013-020966 filed in Japan on Feb. 6, 2013. The entire contents of this Japanese Patent Application No. 2013-020966 are hereby incorporated by reference. Although the invention has been described above by reference to certain embodiments of the invention, the invention is not limited to the embodiment described above. Modifications and variations of the embodiments described above will occur to those skilled in the art in light of the above teachings. The scope of the invention is defined with reference to the following claims.

What is claimed is:

1. A valve timing control system for an internal combustion engine, comprising:

brushes;

slip rings which slide with the brushes;

an intake air side valve timing control device main frame and an exhaust side valve timing control device main frame, both of which are rotated on a basis of a rotational force transmitted from a crankshaft and constitute electrically driven valve timing control devices that modify valve timings by performing a feed of an electric power using the brushes and the slip rings, the electrically driven valve timing control devices being disposed on both of an intake air side camshaft and an exhaust side camshaft;

an intake air side cover member and an exhaust side cover member, both of which are fixed to the internal combustion engine and each of which houses a corresponding one of the intake air side device main frame and exhaust side device main frame in an inner peripheral side of a corresponding one of the intake air side and exhaust side cover members; and seal members which seal between an outer periphery of each of the intake air side and the exhaust side device main frames and an inner periphery of each of the intake air side and the exhaust side cover members, wherein the brushes and the slip rings are disposed within a space formed between each of the intake air side and exhaust side device main frames and each of the intake air side and the exhaust side cover members and partitioned by means of the respective seal members and the respective cover members are configured to enable radial directional position adjustments by a predetermined quantity and are fixed to the internal combustion engine in a state in which the radial directional position adjustments of the respective cover members have been made.

2. The valve timing control system for the internal combustion engine as claimed in claim 1, wherein the intake air side cover member and exhaust side cover member are fixed to the internal combustion engine by means of a plurality of bolts, respectively.

3. The valve timing control system as claimed in claim 2, wherein the intake air side cover member and the exhaust side cover member are configured to enable the radial direction position adjustments on a basis of radial gaps formed between the plurality of bolts and bolt inserting holes through which the respective bolts are inserted.

4. The valve timing control system as claimed in claim 1, wherein the slip rings are disposed on outer and inner peripheries of a tip surface of each device main frame in a double form and the brushes of a positive polarity and of a negative polarity are disposed on each of intake air side cover member and exhaust side cover member to be projected toward the respective slip rings.

5. The valve timing control system as claimed in claim 1, wherein each seal member is an oil seal constituted by a metallic ring and a rubber material.

6. A valve timing control system for an internal combustion engine, comprising:

brushes;

slip rings which slide with the brushes;

an intake air side valve timing control device main frame and an exhaust side valve timing control device main frame, both of which are rotated on a basis of a rotational force transmitted from a crankshaft and constitute electrically driven valve timing control devices that modify valve timings by performing a feed of an electric power using the brushes and the slip rings, the electrically driven valve timing control devices being disposed on both of an intake air side camshaft and an exhaust side camshaft;

an intake air side cover member and an exhaust side cover member, both of which are fixed to the internal combustion engine and each of which houses a corresponding one of the intake air side device main frame and exhaust side device main frame in an inner peripheral side of a corresponding one of the intake air side and exhaust side cover members; and seal members which seal between an outer periphery of each of the intake air side and the exhaust side device main frames and an inner periphery of each of the intake air side and the exhaust side cover members, wherein the brushes and the slip rings are disposed within a space formed between each of the intake air side and exhaust side device main frames and each of the intake air side and the exhaust side cover members and partitioned by means of the respective seal members and the respective cover members are configured to enable an adjustment of a relative position between a position at which the intake air side device main frame is housed and a position at which the exhaust side device main frame is housed.

* * * * *